United States Patent [19]

Dillingham

[11] Patent Number: 4,593,812

[45] Date of Patent: Jun. 10, 1986

[54] NECKTIE TRAVEL CASE

[76] Inventor: Richard F. Dillingham, 4309 Shady Hill, Dallas, Tex. 75229

[21] Appl. No.: 634,623

[22] Filed: Jul. 26, 1984

[51] Int. Cl.[4] ..... A47G 25/74; B65D 85/18

[52] U.S. Cl. ..... 206/292; 206/298; 150/53; 383/23; 223/DIG. 1

[58] Field of Search ..... 150/53; 206/286–290, 206/282, 284, 298, 388, 9, 292; D6/317; 211/113, 119; 223/85, 87, 88, DIG. 1; 383/23

[56] References Cited

U.S. PATENT DOCUMENTS

| | | | |
|---|---|---|---|
| D. 91,319 | 1/1934 | Falk | 211/113 X |
| D. 167,986 | 10/1952 | Jonaitis | 223/88 X |
| D. 183,499 | 9/1958 | Simpson | D6/317 X |
| 1,081,848 | 12/1913 | MacDonald | 150/53 X |
| 1,899,813 | 2/1933 | Lester | 211/113 X |
| 1,981,510 | 11/1934 | Jones | 206/282 X |
| 2,082,011 | 6/1937 | Lee | 150/53 X |
| 2,171,077 | 8/1939 | Branch | 150/52 R |
| 2,488,973 | 11/1949 | Hall | 211/113 X |
| 2,587,850 | 3/1952 | Hoover | 206/298 X |
| 2,593,356 | 4/1952 | Smith | 211/119 |
| 2,659,643 | 11/1953 | Friesz | 206/283 X |
| 2,690,844 | 10/1954 | Torrance | 211/119 |
| 2,895,521 | 7/1959 | Weber | 383/23 X |
| 3,056,490 | 10/1962 | Teetor | 206/298 |
| 3,081,012 | 3/1963 | Sanders | 206/287 X |
| 3,088,597 | 5/1963 | Ritchey | 211/119 X |
| 3,269,554 | 8/1966 | Jay | 211/119 |
| 3,276,601 | 10/1966 | Haggerty | 211/119 |
| 3,592,343 | 7/1971 | Swett et al. | 211/113 X |
| 3,783,995 | 1/1974 | Tobin | 206/281 X |

FOREIGN PATENT DOCUMENTS

| | | | |
|---|---|---|---|
| 540502 | 8/1955 | Belgium | 211/113 |
| 673240 | 10/1964 | Italy | 223/85 |
| 78679 | 4/1950 | Norway | 206/290 |

*Primary Examiner*—William Price
*Assistant Examiner*—Sue A. Weaver
*Attorney, Agent, or Firm*—Hubbard, Thurman, Turner & Tucker

[57] ABSTRACT

A necktie travel case comprising an elongated frame having a formed wire column member and spaced apart hanger and support bars secured to the column member. One end of the column member is formed into a hook portion for hanging a travel case upon a coathook or a hanger rod. An elongated cloth fabric cover is secured to the frame member at one end adjacent the hook portion and is of a length sufficient to be trained around the lower support bar and back along itself to form a closure over one or more neckties which are supported by the hanger bar and folded around the support bar. Flexible straps are secured to one cover flap and are releasably connectable to the other cover flap to close the sides of the cover.

10 Claims, 4 Drawing Figures

NECKTIE TRAVEL CASE

BACKGROUND OF THE INVENTION

1. Field of the Invention

The present invention pertains to a hanger and travel case assembly for carrying haberdashery items, particularly, neckties and the like.

2. Background

Men's neckties and similar articles are particularly difficult to pack in a suitcase or grip and maintain unwrinkled when traveling. Typically men's suitcases and suit bags are not provided with suitable means for storing neckties to prevent them from being crushed or otherwise wrinkled while packed within the case or bag. In most cases the ties tend to slip to the bottom of the bag and are thereby crushed and disfigured by the weight of other articles contained within the bag.

Although certain types of necktie travel cases have been developed, those existing in the prior art are characterized as relatively bulky and cumbersome cases which take up too much room in the suitcase or grip and are not adapted to form a suitable hanger or rack for the neckties when the traveler reaches his destination. Accordingly, there has been a need for a travel case for neckties and the like which provides suitable support and protection for ties to prevent them being wrinkled or crushed, to occupy a minimum amount of space, be lightweight and to provide means for hanging the ties from a conventional coat rack or hanger bar when the travel case is removed from a suitcase or the like. The present invention meets these desiderata as will be appreciated by those skilled in the art upon reading the following.

SUMMARY OF THE INVENTION

The present invention provides an improved necktie travel case for storing neckties and the like in a folded position and including means for protecting the ties from wrinkling or disfigurement when packed in a suitcase and also providing means for hanging the neckties when the case is removed from a suitcase or suit bag.

In accordance with one aspect of the present invention the necktie travel case is characterized by a substantially rigid hanger member having a hanging hook portion and a pair of spaced apart hanger bars for supporting one or more neckties in a folded position and stretched between the hanger bars to prevent wrinkling or disfigurement thereof.

In accordance with another aspect of the present invention the necktie travel case includes a frame having a pair of spaced apart necktie hanger bars for supporting one or more neckties between the bars and including a flexible fabric cover extending from one end of the frame to the other and forming a protective cover on both sides of the frame. The fabric cover is connected at one end to one end of the frame and is of sufficient length to be folded around one of the hanger bars disposed on the frame at a point remote from the point of attachment of the cover whereby the cover may be folded around the hanger bar and secured at its other end to the frame at a point adjacent the point of connection of the first end of the cover to the frame. The flexible cover is preferably provided with releasable closure means for securing opposed flaps of the cover to each other to prevent neckties contained within the case from sliding out from between the flaps.

In accordance with yet another aspect of the present invention there is provided a necktie travel case which is characterized by a formed wire frame having a central, rigid column member for supporting a pair of spaced apart necktie hanger bars around which one or more neckties may be folded and stretched relatively tight and wherein the frame includes a hook member for hanging the frame to serve as a necktie hanger when the case is removed from a suitcase or grip.

Those skilled in the art will recognize and appreciate the above described features of the present invention as well as additional superior aspects thereof upon reading the detailed description herein in conjunction with the drawing.

DESCRIPTION OF THE PREFERRED EMBODIMENT

Figure 1:
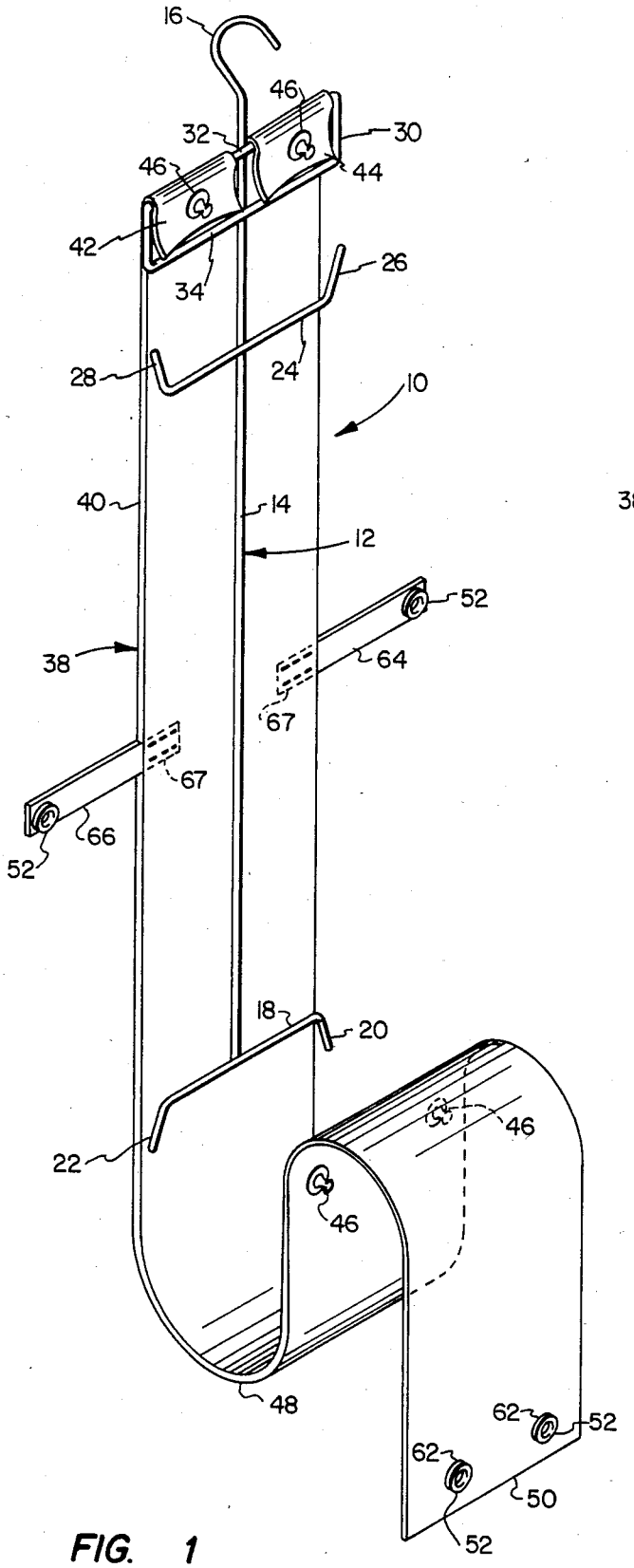
FIG. 1 is a perspective view the necktie travel case of the present invention with the flexible cover detached at one end from the hanger frame.

In the description which follows like parts are marked throughout the specification and drawing with the same reference numerals, respectively. The drawing figures are not necessarily to scale and certain features may be shown exaggerated in scale in the interest of clarity.

Referring to FIG. 1 the necktie travel case of the present invention is generally designated by numeral 10 and is characterized by a frame 12 comprising an elongated formed wire column member 14 which is formed at one end to provide a hanger hook portion 16. A necktie support or hanger bar 18 is suitably secured to the column member 14 at the end of the column member opposite the hook portion 16 as by welding or the like. The support bar 18 includes opposed generally downwardly depending distal leg portions 22 which are disposed in a plane generally parallel to a plane containing the column member 14 and the hook portion 16. A hanger bar 24 is also secured to the column member 14 at a point relatively close to the hook portion 16 and spaced preferably about 12 to 13 inches from the bar 18. The hanger bar 24 includes opposed upturned distal leg portions 26 and 28 coplanar with the leg portions 20 and 22.

The frame 12 also includes a cover support member comprising a somewhat rectangular or D-shaped ring 30 secured to the column member 14 between the hanger bar 24 and the hook 16 and having opposed parallel bar parts 32 and 34. The length of the D ring 30 is approximately the same as the overall length of the bars 18 and 24 inclusive of the distal leg portions of each bar, respectively. The frame 14 is preferably formed of relatively rigid steel wire or bar stock having a nominal diameter of about 0.156 inches and preferably covered with a soft rubber or plastic protective coating.

The necktie travel case 10 is also characterized by a flexible fabric cover 38 having a first flap part 40 having coextensive tabs 42 and 44 formed at one end and folded over the bar part 32 and secured to itself by suitable means such as a pair of conventional rivet type snap fastener parts 46. The cover 38 is of sufficient length to provide a second flap part 48, FIG. 2, which is adapted to be trained around the bar 18 and secured at its distal end 50 to the fastener parts 46 by cooperating snap fastener parts 52 suitably secured to the flap 48 in a conventional manner.

Figure 4:
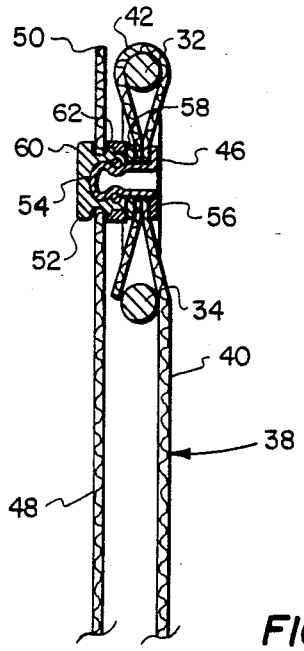
FIG. 4 is a detailed section view taken generally along the line 4—4 of FIG. 2.

Referring briefly to FIG. 4, one of the fastener assemblies comprising a fastener part 46 and a fastener part 52 is shown in assembled relationship with the cover 38 closed. The fastener part 46 includes a post member 54 having a peripheral flange 56 and extending through the layers of material forming the cover 38 and secured thereto by a collar 58. The fastener part 52 includes a button member 60 which extends through the layer of material forming the flap 48 and is secured thereto by a fastener socket 62. The fastener socket 62 is releasably engageable with the post member 54 to form the fastener connection between the parts 46 and 52. Those skilled in the art will recognize that other cooperable fastener parts may be substituted for the fastener parts 46 and 52 without departing from the scope of the present invention.

Figure 2:
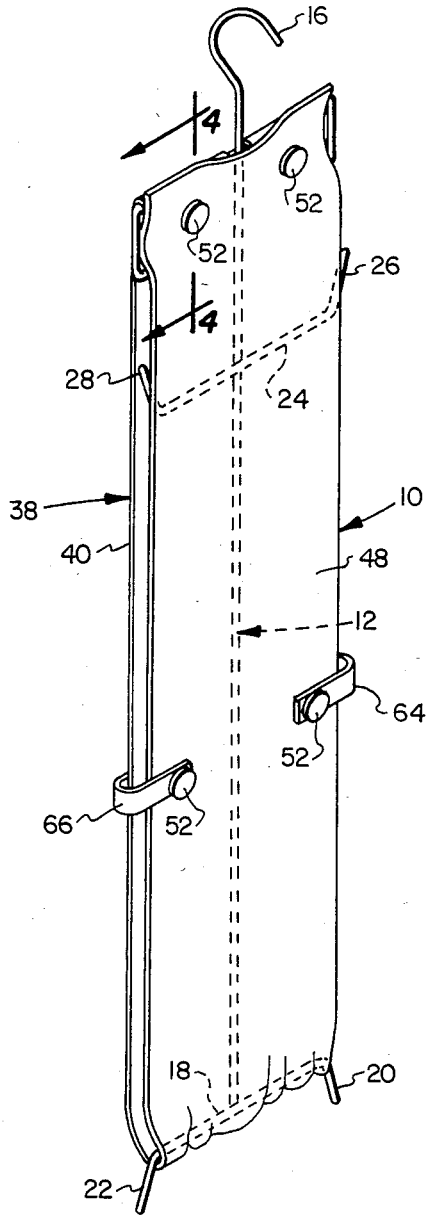
FIG. 2 is a perspective view similar to FIG. 1 showing the cover in the closed and secured position relative to the hanger frame.

Referring to FIGS. 1 and 2, the necktie travel case 10 includes additional fastener means for securing the flaps 40 and 48 to each other comprising a pair of opposed strap members 64 and 66 secured to the cover flap 40 approximately midway between the bars 18 and 24. The strap members 64 and 66 may be suitably secured to the cover member 38, if formed as separate parts, by stitching 67, for example, or may be integrally formed as part of the cover member 38. Fastener parts 52 are secured to the distal ends of the respective strap members 64 and 66 and are operable to be secured to cooperating fastener parts 46 mounted on the flap 48 about midway the length of the flap between the distal end 50 and the point at which the cover 38 is reversely trained around the bar 18 thereby placing the fastener parts 46 generally aligned with the strap members 64 and 66. In the closed position of the cover member 38, illustrated in FIG. 2, the strap members 64 and 66 are adapted to secure the flaps 40 and 48 loosely to each other and to prevent neckties supported by the frame 12 from falling out of the travel case through the space formed between the cover flaps 40 and 48. The cover 38 is preferably formed of a conventional woven fabric such as a relatively lightweight blend of cotton or wool and polyester for aesthetic purposes as well as for durability and wrinkle resistance. The color of the cover member 38 is preferably coordinated with the color of any coating placed on the frame 12 such as described previously.

Figure 3:
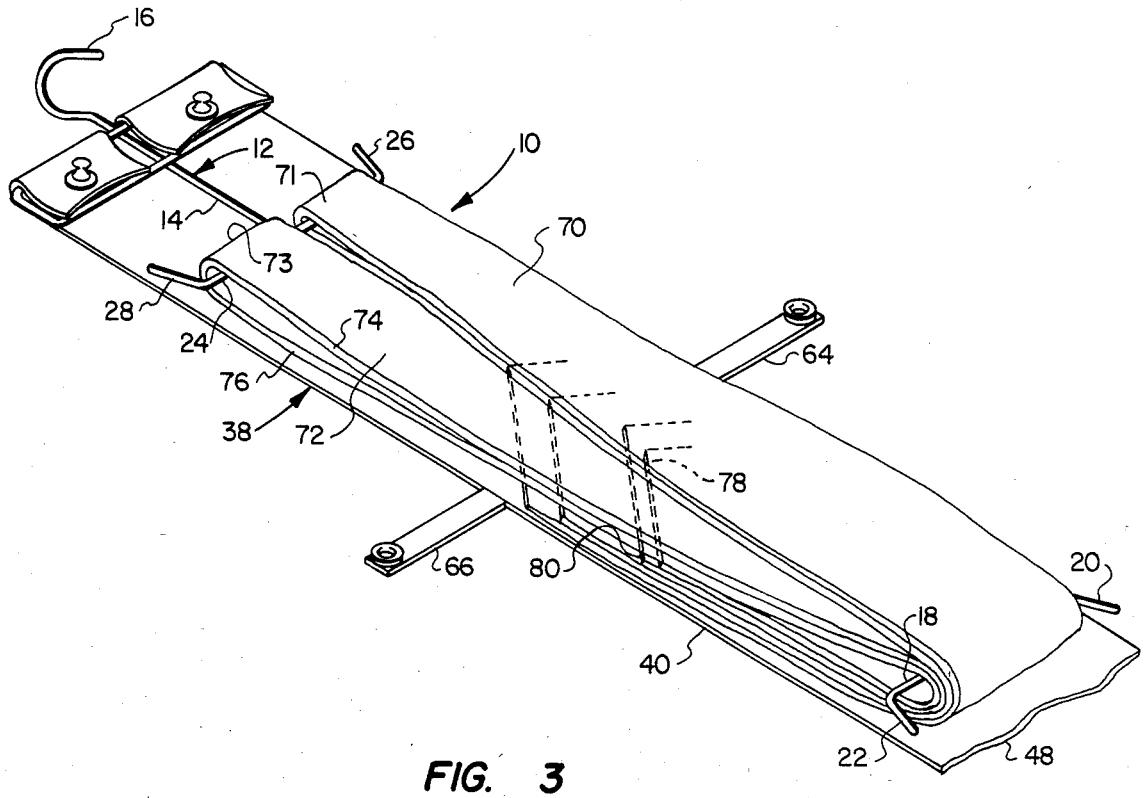
FIG. 3 is a perspective view showing a pair of neckties supported on and folded over the hanger bars on the hanger frame.

Referring to FIG. 3, the travel case 10 is illustrated in a reclined position with two neckties 70 and 72 supported on the frame 12 and folded into a position for being carried by the case 10 upon closure of the cover by training the flap 48, partially shown in FIG. 3, around the bar 18 and securing the distal end, not shown in FIG. 3, to the opposite end of the cover 38 as illustrated in FIG. 2. The neckties 70 and 72 are illustrated as conventional four in hand ties which are supported by the hanger bar 24 at points 71 and 73 approximately midway between opposite ends of the ties. As illustrated for the tie 72, the opposed coextensive bands 74 and 76 are then trained around the bar 18 and folded under themselves so that the ends 78 and 80 are disposed between the cover flap 40 and the portions of the bands 74 and 76 which extend between the bars 18 and 24. The distance between the legs 20 and 22 of bar 18 is slightly greater than the width of at least one necktie. In this regard the necktie 70 may then be laid over the necktie 72 and folded under the necktie 72 also between the ends 78 and 80 of necktie 72 and the cover flap 40. In this way the neckties 70 and 72 are conveniently folded in a relatively taut position to minimize the chance of wrinkling or dishevelment of the ties. Upon securing the flap 48 to the upper end of the frame 12, as afore described, and securing the straps 64 and 66 to flap 48, the ties 70 and 72 are neatly retained between the cover flaps. Moreover, the flexibility of the material of the cover 38 provides some cushioning effect without crushing or flattening the ties 70 and 72 so that a fullness or not overpressed look is retained by the ties.

As will be appreciated by those skilled in the art, the travel case 10 may be easily packed in a conventional suitcase, suit bag, or grip and laid between shirts, and other items of haberdashery without wrinkling or creasing the ties. Once the traveler has reached his destination, the travel case 10 may be removed from the suitcase and the flap 48 undone, if desired, and the hanger frame 12 may be hung by the hook 16 in a conventional manner on a hanger rod or the like so that the ties 70 and 72 may hang downwardly from the hanger bar 24. The ties 70 and 72 are then readily accessible for use when desired. The travel case 10 may be used with one, two or even as many as four to six neckties since additional neckties may be hung around the hanger bar 24, over the ties 70 and 72 and folded around the support bar 18 in the same manner. The overall width of the cover 38 is slightly less than the distance between the legs 20 and 22 of the bar 18 and the configuration of the bars 18 and 24 may be identical. The overall width of the cover 38 may also be slightly greater than the nominal maximum width of the average four in hand necktie whereby the travel case takes up a minimum amount of space in a suitcase or the like.

Although a preferred embodiment of the present invention has been described in detailed herein, those skilled in the art will recognize that various substitutions and modifications may be made to the specific embodiment shown and described without departing from the scope and spirit of the invention as recited in the appended claims.

What I claim is:

1. A necktie case comprising:

a frame including first and second necktie support members spaced apart from each other and substantially parallel to each other to define a form about which a necktie may be folded, said support members each having opposed distal end portions extending away from the other support member for retaining said necktie on said each support member; and, a flexible elongated cover secured at one end to said frame and folded over said support members and fastened near said one end of the frame, said cover being engagingly wrapped around one of the support members so as to engage at said one support member a necktie which is folded over said one support member.

2. The necktie case of claim 1 wherein:

said flexible cover provides opposed generally coextensive flaps enclosing said necktie.

3. The necktie case of claim 2 wherein:

said frame comprises an elongated rigid column member and wherein said support members include at least two rigid support bars secured transversely on said column member parallel to each other positioned near opposite ends of said column member.

4. The necktie case according to claim 3 wherein:

the support bars are secured to said column member about midway of their length and one of said support bars is secured to the end of said column member.

5. The necktie case according to claim 3 including:

a hook member secured to one end of said column member.

6. The necktie case according to claim 5 including:

a generally elongated member secured to said column member adjacent to said hook member for supporting one end of said cover connected thereto.

7. The necktie case according to claim 3 including:

first fastener means on a distal end of one of said flaps cooperable with second fastener means on the opposite end of said cover for fastening said cover to enclose said necktie.

8. The necktie case according to claim 3 including:

fastener means on one of said flaps between said support bars for securing said flaps together to retain said necktie between said flaps.

9. The necktie case according to claim 8 wherein:

said fastener means comprise opposed strap members having quick release fastener parts secured thereto and engageable with cooperating quick release fastener parts on one of said flaps.

10. A necktie case comprising:

a frame including an elongated column member having a hook portion formed at one end, a first necktie support member on said column member adjacent to said hook portion, and a second support member generally parallel to said first support member at the end of said column member opposite said first support member; said first and second support members being rigidly secured to said column member in a fixed position with each other and each having distal end portions extending away from the other support member, to thereby define a form about which neckties may be engagingly folded and secured against slipping off said support members; and a flexible cover secured to said frame at one end between said hook portion and said first support member and extending longitudinally along said column member, said cover being of a length sufficient to be engagingly folded around said second support member and to be secured relative to said frame at the opposite end of said cover to enclose said first and second support members between adjacent flaps formed by said cover and so as to engage at said second support member and enclose a necktie folded about said first and second support members.

* * * * *